US011597981B2

(12) United States Patent
Park

(10) Patent No.: US 11,597,981 B2
(45) Date of Patent: Mar. 7, 2023

(54) PREPARING METHOD OF ENGINE VALVE

(71) Applicants: Hyundai Motor Company, Seoul (KR); Kia Motors Corporation, Seoul (KR)

(72) Inventor: Sung Hwan Park, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 395 days.

(21) Appl. No.: 16/806,679

(22) Filed: Mar. 2, 2020

(65) Prior Publication Data

US 2021/0172034 A1 Jun. 10, 2021

(30) Foreign Application Priority Data

Dec. 6, 2019 (KR) ..... 10-2019-0161997

(51) Int. Cl.

| | |
|---|---|
| ***C21D 10/00*** | (2006.01) |
| ***C21D 8/00*** | (2006.01) |
| ***B21D 31/06*** | (2006.01) |
| ***B21D 53/10*** | (2006.01) |
| ***F01L 3/02*** | (2006.01) |

(52) U.S. Cl.

CPC ..... *C21D 8/005* (2013.01); *B21D 31/06* (2013.01); *B21D 53/10* (2013.01); *C21D 10/00* (2013.01); *F01L 3/02* (2013.01)

(58) Field of Classification Search

CPC ..... B21D 31/06; B21D 53/10; B21K 1/22; B24B 15/04; B24B 5/36; C21D 10/00; C21D 8/005; C21D 9/0068; F01L 3/02; C23C 8/26; C23C 8/80

See application file for complete search history.

(56) References Cited

U.S. PATENT DOCUMENTS

| | | | | |
|---|---|---|---|---|
| 9,181,824 | B2 | 11/2015 | Montagnon | |
| 2004/0261746 | A1* | 12/2004 | Narasimhan | F01L 3/14 29/888.4 |
| 2007/0277911 | A1 | 12/2007 | Baba et al. | |

FOREIGN PATENT DOCUMENTS

| | | | |
|---|---|---|---|
| CN | 103990944 | A | 8/2014 |
| EP | 1696108 | A1 | 8/2006 |
| EP | 1767750 | A1 | 3/2007 |
| EP | 2811126 | A1 | 12/2014 |
| EP | 3401412 | A1 | 11/2018 |
| GB | 1386702 | A | 3/1975 |
| JP | 3671271 | B2 | 7/2005 |

OTHER PUBLICATIONS

NPL: on-line translation of CN 103990944 A1,Aug. 2014 (Year: 2014).*

* cited by examiner

*Primary Examiner* — Jie Yang
(74) *Attorney, Agent, or Firm* — Fox Rothschild LLP

(57) ABSTRACT

A method of preparing an engine valve is provided. The method includes hot forging a heat resistant steel at 1,150 to 1,250° C. to mold a valve, aging the molded valve and hollowed-out processing the aging valve. Additionally, the method includes nitride-heating the hollow valve and grinding a surface of a neck of the nitride-heated valve to remove a nitride layer.

5 Claims, 3 Drawing Sheets

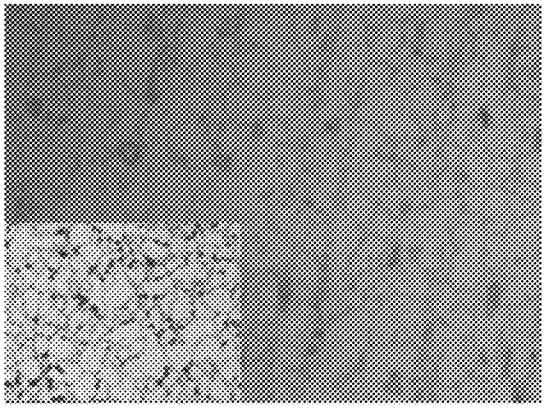
FIG. 3A
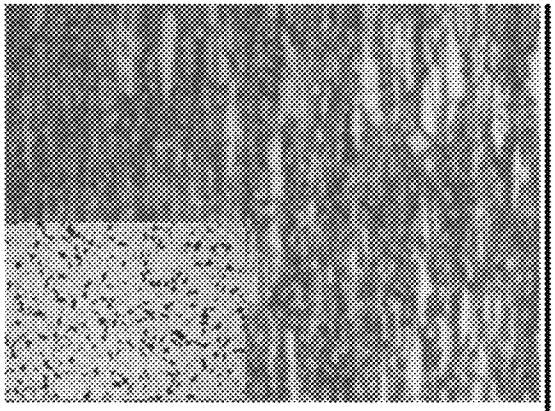
FIG. 3B
FIG. 3C

PREPARING METHOD OF ENGINE VALVE

CROSS-REFERENCE TO RELATED APPLICATION

This application claims the benefit of priority to Korean Patent Application No. 10-2019-0161997, filed on Dec. 6, 2019, the entire contents of which are incorporated herein by reference.

TECHNICAL FIELD

The present disclosure relates to a method of preparing an engine valve having improved physical properties such as strength and fatigue life at a high temperature and improved creep life.

BACKGROUND

Referring to FIG. 1 of the prior art, a hollow engine valve "A" for a vehicle typically includes three members, i.e., a valve head "1", a hollow shaft "2", and a shaft end sealant "3". In the hollow engine valve, particularly an exhaust hollow engine valve exposed to a high temperature, a material having excellent heat resistance such as manganese-based heat resistant steel or nickel-based heat resistant steel is applied to the valve head exposed to the highest temperature and general steel or heat resistant steel is applied to the hollow shaft and the shaft end sealant.

Meanwhile, recently developed high-power engine has a higher exhaust gas temperature than the existing engine, and thus durability of a neck of the exhaust valve is insufficient. A method of improving the neck durability of the exhaust valve has been developed that includes changing to a material having excellent heat resistance and a method of securing durability by reinforcing the neck shape of the exhaust valve. In changing the material, the material cost increases. Furthermore, the neck shape reinforcement increases the weight of the exhaust valve, thereby increasing friction and degrading characteristics of a valve system.

Another developed technique includes a method of manufacturing an engine exhaust valve in which a heat resistant steel of a specific composition is used as a material, a shape of the exhaust valve which consists of a valve head and a shaft is provided by cold forging or warm forging after performing a solution treatment, and aging treatment is performed at 600 to 800° C. for 0.5 to 4 hours. However, when this method is performed at 900 to 1,100° C., a solid solution treatment is progressed insufficiently which limits the high temperature properties, which display the heat resistant steel. When applying the manufactured valve, pore or micro cracks occur in the neck of the valve head exposed to the high temperature of 700 to 800° C. for a long period of time.

Therefore, there is a need for research and development on a method of manufacturing an engine valve, which does not cause the increase in material cost and in the weight of the valve, has improved physical properties such as strength and fatigue life at the high temperature and being less durability degradation even when exposed to the high temperature for a long period of time, and has improved creep life.

SUMMARY

The present disclosure provides a method of preparing an engine valve improved in physical properties, such as strength and fatigue life at a high temperature to be less durability degradation even when exposed to the high temperature for a long period of time and improved in creep life, and an engine valve.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a method of preparing an engine valve may include hot forging a heat resistant steel at about 1,150 to 1,250° C. to mold a valve, aging the molded valve, hollowed-out processing the aging valve, nitride-heating the hollow valve, and grinding a surface of a neck of the nitride-heated valve to remove a nitride layer. According to another aspect of the present disclosure, an engine valve made of heat-resistance steel and having a hollowness is provided. The valve may include a nitride layer, and the nitride layer may be formed on a surface of the valve except for a neck of the valve. According to an aspect of the present disclosure, an engine may include the above-described engine valve. According to another aspect of the present disclosure, a vehicle may include the above-described engine.

BRIEF DESCRIPTION OF THE DRAWINGS

The above and other objects, features and advantages of the present disclosure will be more apparent from the following detailed description taken in conjunction with the accompanying drawings:

FIGS. 3A-3C are scanning electron microscope (SEM) images of valve heads of Example 1 and Comparative Examples 1 and 2 measured in Test Example 1.

DETAILED DESCRIPTION

Figure 1:
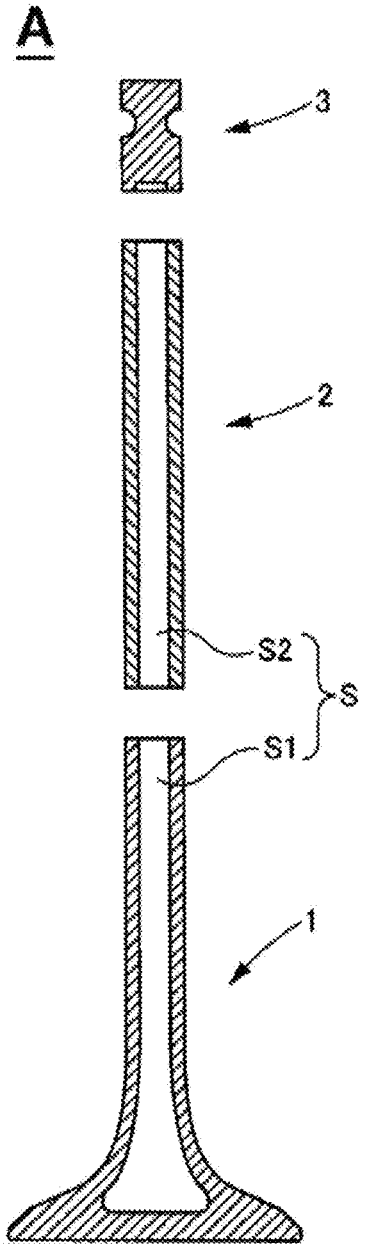
FIG. 1 PRIOR ART
FIG. 1 is an exploded cross-sectional view of each member of a conventional engine valve according to the prior art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, the present disclosure will be described in detail. As used herein, when a part is said to "include" a certain component, it means that it may further include other components, without excluding the other components unless otherwise stated. As used herein, when a member is located "on" another member, this includes not only when one member is in contact with another member but also when another member exists between the two members.

Method of Preparing Engine Valve

A method of preparing an engine valve according to an exemplary embodiment of the present disclosure may include molding a valve by hot forging, performing aging treatment, hollowed-out processing, performing nitride-heat treatment, and removing a nitride layer. In particular, when the engine burns, i.e., the engine is exposed at about 700 to 800° C., the nitride layer diffuses and the density of the nitride layer decreases to generate pores or micro cracks in a neck of a head of nitride-heated valve. The preparing method of the present disclosure removes the nitride layer of the surface of the neck of the nitride-heated valve to improve durability of the valve. In addition, the preparing method may perform hot forging at about 1,150 to 1,250° C. to sufficiently perform solid solution treatment, and thus the engine valve may be manufactured to have a maximum physical property at a high temperature, which displays heat resistant steel.

Molding

In this step, the heat resistant steel may be hot forged at about 1,150 to 1,250° C. to mold a valve. The heat resistant steel may be not particularly limited as long as it is conventional heat resistant steel. For example, the heat resistant steel may include one or more selected from the group consisting of SUH35, SUH35NbW, NCF3015, and SUH330NM. In addition, the components of the heat resistant steel are shown in Table 1 below.

TABLE 1

| (weight %) | C | Si | Mn | Ni | Cr | W | Nb | Ti | l |
|---|---|---|---|---|---|---|---|---|---|
| SUH35 | 0.48~0.58 | 0.35 or less | 8.0~10.0 | 3.25~4.50 | 20.0~22.0 | — | — | — | — |
| SUH35NbW | 0.45~0.55 | 0.45 or less | 8.0~10.0 | 3.50~5.50 | 20.0~22.0 | 0.80~1.50 | 1.8~2.5 | — | — |
| NCF3015 | 0.08 or less | 0.50 or less | 0.50 or less | 29.5~33.5 | 13.5~17.0 | — | 0.40~1.0 | 2.3~3.0 | 1.0~2.0 |
| SUH330NM | 0.08 or less | 0.50 or less | 0.50 or less | 39.0~43.0 | 14.0~16.0 | — | 1.0~1.5 | 2.0~2.6 | 1.6~2.2 |

This process may include hot forging for about 15 to 25 seconds at about 1,150 to 1,250° C. Carbides produced during the forging process sufficiently perform the solid solution treatment to coarsen grains at the above temperature for the above processing time during hot forging, thereby improving the high temperature properties of the valve. When the hot forging temperature is less than the above range, the solid solution treatment is incomplete and the carbides produced during the forging process do not completely perform the solid solution treatment to suppress grain growth at the high temperature.

Hereafter, the untreated carbides may be coarsened during aging to decrease strength of the prepared valve at the high temperature. Meanwhile, when the hot forging temperature is greater than the above range, forging molding may occur due to generation of scale during hot forging or the grain coarsening due to the excessive solid solution treatment may cause inadequate carbide precipitation during aging, thereby lowering the strength of the prepared valve at the high temperature.

Performing Aging Treatment

In this step, the molded valve is aged. Particularly, the aging treatment enhances the physical properties of the prepared valve at the high temperature to thus sufficient precipitate carbides produced during hot forging. The aging treatment may be performed for about 0.8 hours to 1.2 hours at about 740° C. to 780° C. When the aging treatment temperature is within the above range, the carbide precipitation occurs sufficiently, and when the aging treatment time is out of the above range, the carbide precipitation becomes unstable and the high temperature properties are deteriorated.

Hollowed-Out Processing

In this step, the age-treated valve is hollowed out. The hollowed-out processing is not particularly limited as long as it is a hollowed-out processing method typically used in the manufacture of the valve. In addition, the preparing method may further include performing surface treatment between the hollowed-out processing and the performing of nitride-heat treatment Particularly, the performing of surface treatment may be surface treatment by grinding the surface of the hollowed-out processed valve. In addition, the surface treatment increases efficiency of the nitride-heat treatment to grind the surface of the hollowed-out processed valve to improve surface roughness.

Performing Nitride-Heat Treatment

In this step, the nitride-heat treatment of the hollowed out processed valve is performed. Particularly, the nitride-heat treatment improves wear resistance of the valve. The nitride-heat treatment usually includes a salt bath soft nitride treatment or gas soft nitride treatment.

Removing Nitride Layer

In this step, the surface of the neck of the nitride-heated valve is grinded to remove the nitride layer. In general, when exposed to the high temperature, i.e., about 700 to 800° C. for a long period of time, the nitride layer is diffused and the density is reduced to generate pores or micro cracks on the surface. However, in this step, the nitride layer on the surface of the neck of the valve is removed and thus, there are no pores or micro cracks on the surface thus improving the durability of the valve.

Figure 2:
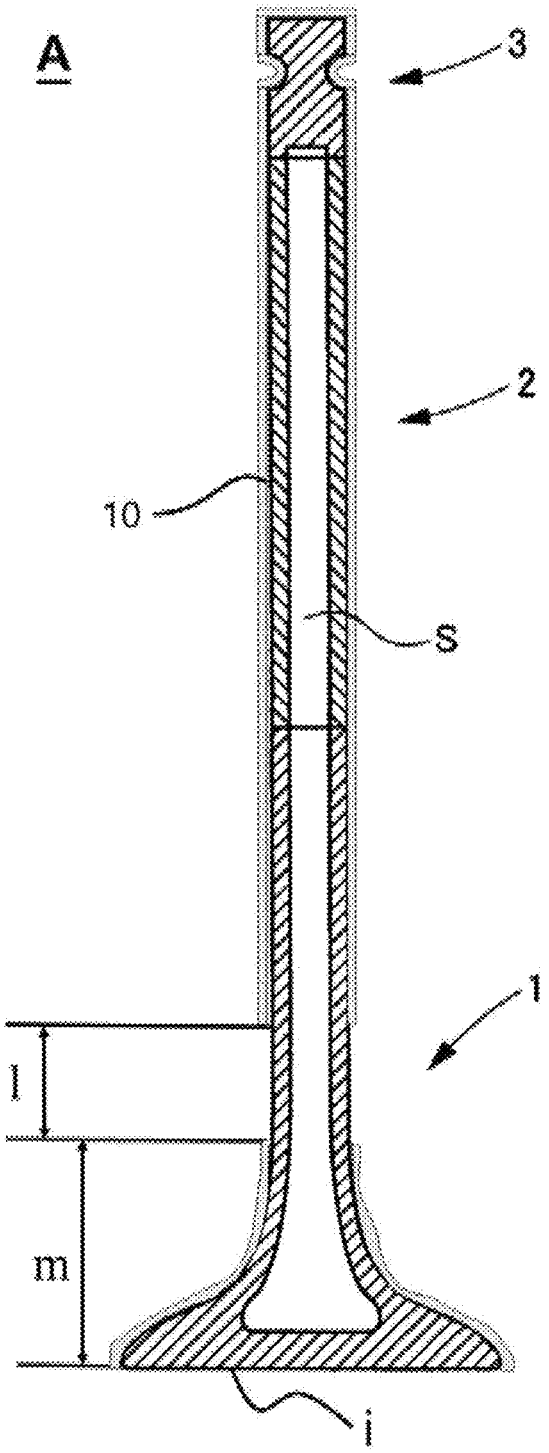
FIG. 2 is a cross-sectional view of an engine valve according to an exemplary embodiment of the present disclosure.

The neck to be grinded may disposed about 10 to 40 mm away from an inlet, which has a maximum diameter of the valve. Referring to FIG. 2, the neck to be grinded may disposed about 10 to 40 mm away from an inlet part "i" having the largest diameter, that is, a length "l" of the neck to be grinded may be about 5 to 20 mm, or about 8 to 15 mm. In addition, the beginning of the neck to be grinded may be about 10 to 40 mm or about 20 to 30 mm away from the inlet "i" having the largest diameter, i.e., a distance "m" between the inlet having the largest diameter and the beginning of the neck to be grinded may be about 10 to 40 mm or about 20 to 30 mm. This step may include grinding the surface of the neck by about 30 to 70 m depth. The method of preparing the engine valve as described above may manufacture the engine valve, which maintains the existing material and shape to prevent an increase in material cost and the weight of the prepared valve and has improved durability.

Engine Valve

In addition, the engine valve according to another exemplary embodiment of the present disclosure is a valve made of heat resistant steel and having hollowness and including a nitride layer. The nitride layer may be formed on the surface of the valve except the neck of the valve. Particularly, the neck may be disposed about 10 to 40 mm away from the inlet having the maximum diameter of the valve. In addition, the heat resistant steel may be not particularly limited as long as it is the conventional heat resistant steel. For example, the heat resistant steel may include one or more selected from the group consisting of SUH35, SUH35NbW, NCF3015, and SUH330NM.

FIG. 2 illustrates the engine valve "A" that may include a valve head "1", a hollow shaft "2", and a shaft end sealant "3". The engine valve "A" may include a nitride layer 10, and a neck of the valve head "1" does not include the nitride layer 10. The engine valve may have an average size of grains of an internal matrix of about 2 to 5 μm, or about 2.5 to 4.0 μm. When the average size of the grains of the internal matrix is within the above range, the high temperature creep rupture life is increased. In addition, the engine valve may not include coarsened grains having an average grain size greater than about 5 μm.

Further, the engine valve may have a rupture time of about 50 to 70 minutes when a static load of about 160 MPa is applied at about 800° C. The engine valve is excellent in physical properties such as strength and fatigue life at the high temperature of about 700 to 800° C. to have less durable degradation when exposed to the high temperature for a period of time, and has improved creep life to be suitable as an exhaust valve of a high power engine.

Engine and Vehicle

The present disclosure provides an engine including the above-described engine valve. The engine may be a high power engine. In particular, the high power engine may have a power output of about 250 to 450 hp. The high power engine has a higher exhaust gas temperature compared to the conventional engine and a temperature at which an exhaust valve is exposed is also high, thereby requiring the exhaust valve with improved durability. The engine valve according to the present disclosure is suitable as the exhaust valve of the high power engine because durability deterioration is less when the engine valve is exposed at the high temperature for a long period of time. In addition, the present disclosure provides a vehicle including the above-described engine.

Hereinafter, the present disclosure will be described in more detail with reference to Examples. However, Examples are only to aid the understanding of the present disclosure, and the scope of the present disclosure in any sense is not limited to Examples.

EXAMPLE

Example 1 and Comparative Examples 1 and 2. Preparing Valve Head

A steel grade SUH35NbW was hot forged at temperatures for processing times as shown in Table 1 below, was cooled using air, and was aged at 760° C. for 1 hour to prepare a valve head.

Test 1

Tensile strength, creep rupture time, and grain size at the high temperature were measured in the following manners for the valve heads of Example 1 and Comparative Examples 1 and 2, and results were shown in Table 2 and FIG. 3.

(1) Tensile Strength at High Temperature

High temperature tensile strength at 800° C. was measured by a KS D 0026 test method.

(2) Creep Rupture Time

The head was heated to 800° C. through high frequency induction heating and static load of 160 MPa was applied to measure time to be broken.

(3) Grain Size

The grain size of the head was measured by the KS D 0205 test method.

TABLE 2

| Categories | Material | hot forging molding condition | Tensile strength | Creep rupture time | Grain (μm) |
|---|---|---|---|---|---|
| Example 1 | SUH35NbW | 1,200° C. × 20 seconds | 260 MPa | 60 minutes | 3.16 |
| Comparative Example 1 | SUH35NbW | 1,100° C. × 20 seconds | 225 MPa | 15 minutes | 1.16 |
| Comparative Example 2 | SUH35NbW | 1,300° C. × 20 seconds | 240 MPa | 80 minutes | 6.32 |

As shown in Table 2 and FIG. 3, the valve head of Example 1 was excellent in tensile strength at 800° C., and had long creep rupture time and appropriate grain size. On the other hand, Comparative Example 1 hot forged at low temperature and Comparative Example 2 hot forged at the high temperature lacked the tensile strength at the high temperature, and the grains were too small or too large.

Example 2. Preparing Engine Valve

The valve head of Example 1 was hollowed out, grinded at the surface thereof by a conventional processing method to perform surface treatment, and was nitride-heated by a salt bath soft nitriding method. Then, the neck having a length of 10 mm from a part 20 mm away from the inlet having the maximum diameter of the valve was grinded by 50 μm depth to remove the nitride layer, thereby forming the engine valve.

Comparative Example 3

An engine valve was prepared in the same manner as Example 2, except that the nitride layer of the neck was not removed.

Test Example 2. Evaluation of High Temperature Fatigue Performance of Engine Valve The engine valves of Example 2 and Comparative Example 3 were heated to 800° C. through high frequency induction heating, the static load of 160 MPa was applied until rupture occurred, and the results were shown in Table 3.

TABLE 3

| | High Temperature Fatigue Performance |
|---|---|
| Example 2 | 6.3 × 105 |
| Comparative Example 3 | 3.2 × 105 |

As shown in Table 3, it was seen that the engine valve of Example 2 from which the nitride layer of the neck of the head was removed was significantly superior in the high temperature fatigue performance as compared to Comparative Example 3, which did not remove the nitride layer of the neck.

As described above, the method of preparing the engine valve prepared the engine valve which maintained the existing material and shape without increase of the cost of the material and the weight of the prepared valve, and had the excellent durability. In particular, it was shown that the engine valve according to the present disclosure had excellent physical properties such as strength and fatigue life at the high temperature of 700 to 800° C. to have less durability deterioration even when exposed to the high temperature for a long period of time, and had improved creep life to be suitable as the exhaust valve of high power engine.

The method of manufacturing the engine valve according to the present disclosure may be formed the engine valve, which maintains the existing material and shape without an increase in the cost of the material and the weight of the prepared valve, and has improved durability. In particular, the engine valve according to the present disclosure has excellent physical properties such as strength and fatigue life at the high temperature of 700 to 800° C. to have less durability deterioration when exposed to the high temperature for a long time and has improved creep life to be suitable as the exhaust valve of the high power engine.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A method of preparing an engine valve, comprising:

hot forging a heat resistant steel at 1,150 to 1,250° C. to mold a valve;

aging the molded valve;

hollowed-out processing the aging valve;

nitride-heating the hollow valve; and grinding a surface within a neck of the nitride-heated hollow valve to remove a nitride layer on the surface with the neck;

wherein the surface within the neck of the nitride-heated hollow valve to be grinded is disposed 10 to 40 mm away from an inlet which has a largest diameter of the valve.

2. The method of claim 1, wherein the aging of the molded valve is performed for 0.8 to 1.2 hours at 740 to 780° C.

3. The method of claim 1, wherein the molding of the valve includes the hot forging at 1,150 to 1,250° C. for 15 to 25 seconds.

4. The method of claim 1, wherein the removing of the nitride layer includes grinding the surface within the neck of the nitride-heated hollow valve by 30 to 70 μm in depth.

5. The method of claim 1, further comprising:

grinding the surface of the hollow valve between the hollowed-out processing and the nitride-heating.

* * * * *